US007591317B2

(12) United States Patent
Bane et al.

(10) Patent No.: US 7,591,317 B2
(45) Date of Patent: Sep. 22, 2009

(54) TUBING PRESSURE INSENSITIVE CONTROL SYSTEM

(75) Inventors: Darren E. Bane, Broken Arrow, OK (US); David Z. Anderson, Glenpool, OK (US); Aaron T. Jackson, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 393 days.

(21) Appl. No.: 11/595,607

(22) Filed: Nov. 9, 2006

(65) Prior Publication Data

US 2008/0110611 A1 May 15, 2008

(51) Int. Cl.
*E21B 34/10* (2006.01)

(52) U.S. Cl. ..... 166/375; 166/321; 166/324

(58) Field of Classification Search ..... 166/321, 166/324, 375

See application file for complete search history.

(56) References Cited

U.S. PATENT DOCUMENTS

| | | | |
|---|---|---|---|
| 3,696,868 | A | 10/1972 | Taylor, Jr. |
| 4,341,266 | A | 7/1982 | Craig |
| 4,791,990 | A | 12/1988 | Amani |
| 6,109,351 | A | 8/2000 | Beall |
| 6,237,693 | B1 | 5/2001 | Deaton |
| 6,427,778 | B1 | 8/2002 | Beall et al. |
| 6,513,594 | B1 | 2/2003 | McCalvin et al. |
| 6,866,101 | B2 | 3/2005 | Sloan |
| 7,392,849 | B2 | 7/2008 | Lauderdale et al. |
| 2002/0046845 | A1 | 4/2002 | Rayssiguier et al. |

FOREIGN PATENT DOCUMENTS

| | | | |
|---|---|---|---|
| GB | 2147643 | A | 5/1985 |
| GB | 2148979 | A | 6/1985 |
| GB | 2243634 | A | 11/1991 |
| WO | 03/062595 | A1 | 7/2003 |

OTHER PUBLICATIONS

Millet, Francois, et al., "Improving Well Safety and Maximizing Reserves Using an Innovative Surface Controlled Subsurface Safety Valve", SPIE 113829, Sep. 2008, 1-8.

Abou-Sayed, Omar A., et al., "Development of a Through-Flow-Line (TFL)-Deployed Insert Surface Controlled Subsurface Safety Valve", SPE 62956, Oct. 2000, 1-11.

Afolabi, Folorunso, et al., "Rigless Installation of Safety Valves To Implement a Well-integrity Campaign and Return Wells to Production", SPE 106533, Mar. 2007, 1-7.

Li, L.J., et al., "Improving the Closing Characteristics of Subsurface Safety Valve with Combined FEA and CFD Modeling/Numerical Analysis", SPE 93941, Mar.-Apr. 2008, 1-9.

Bolding, Jeff L., et al., "Resurrecting a Low-Pressure Gas Well Offshore: Through-Tubing Foamer Injection via a Capillary Tubing System and a Specialized WRSCSSV", SPE 110086, Nov. 2007, 1-11.

*Primary Examiner*—Giovanna C Wright
(74) *Attorney, Agent, or Firm*—Steve Rosenblatt

(57) ABSTRACT

A control system can be used with a single control line to a subsurface safety valve. The operating piston is exposed to the flow tube between two blocks with near identical seals to make the piston insensitive to tubing pressure. A control system seal is carried by the piston in the upper block and a passage between the control system seal and the tubing pressure seal in the upper block communicates to a compressible fluid reservoir in the lower block that is also isolated from tubing pressure by a tubing pressure seal. Movement of the piston compresses the fluid in the reservoir. The reservoir can also include a spring to return the piston and the flow tube to a position to close the valve. A redundant system can be actuated if the primary system fails.

22 Claims, 1 Drawing Sheet

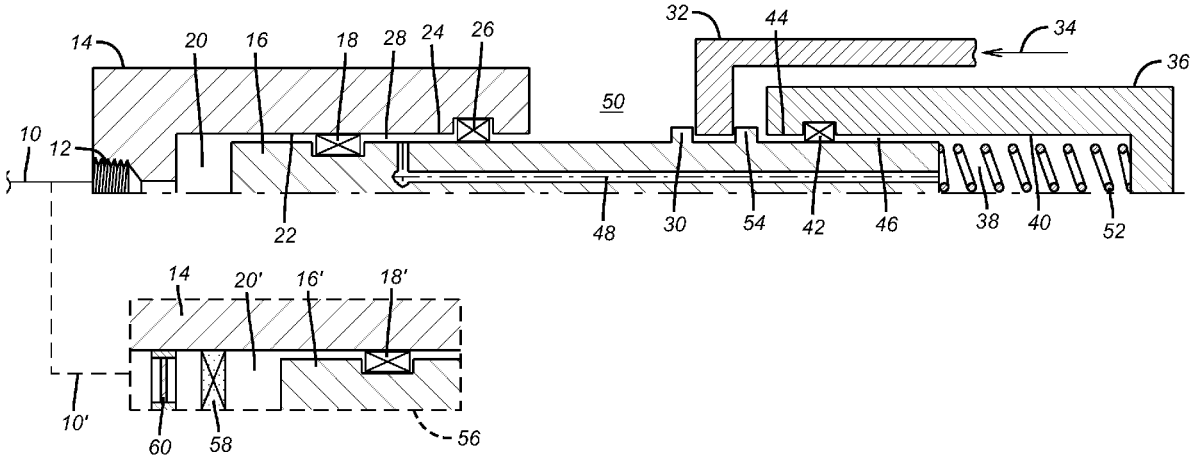
14
20
16
18
28
24
26
32
44
34
36
50
10
12
22
48
30
54
42
46
38
40
52
14
20'
16'
18'
10'
60
58
56

TUBING PRESSURE INSENSITIVE CONTROL SYSTEM

FIELD OF THE INVENTION

The field of this invention is control systems for downhole valves and, more particularly, for subsurface safety valves where the system is tubing pressure insensitive.

BACKGROUND OF THE INVENTION

Subsurface safety valves are used in wells to close them off in the event of an uncontrolled condition to ensure the safety of surface personnel and prevent property damage and pollution. Typically these valves comprise a flapper, which is the closure element and is pivotally mounted to rotate 90 degrees between an open and a closed position. A hollow tube called a flow tube is actuated downwardly against the flapper to rotate it to a position behind the tube and off its seat. This is described as the open position. When the flow tube is retracted the flapper is urged by a spring mounted to its pivot rod to rotate to the closed position against a similarly shaped seat.

The flow tube is operated by a hydraulic control system that includes a control line from the surface to one side of a piston. Increasing pressure in the control line moves the piston in one direction and shifts the flow tube with it. This movement occurs against a closure spring that is generally sized to offset the hydrostatic pressure in the control line, friction losses on the piston seals and the weight of the components to be moved in an opposite direction to shift the flow tube up and away from the flapper so that the flapper can swing shut.

Normally, it is desirable to have the flapper go to a closed position in the event of failure modes in the hydraulic control system and during normal operation on loss or removal of control line pressure. The need to meet normal and failure mode requirements in a tubing pressure insensitive control system, particularly in a deep set safety valve application, has presented a challenge in the past. The results represent a variety of approaches that have added complexity to the design by including features to ensure the fail safe position is obtained regardless of which seals or connections fail. Some of these systems have overlays of pilot pistons and several pressurized gas reservoirs while others require multiple control lines from the surface in part to offset the pressure from control line hydrostatic pressure. Some recent examples of these efforts can be seen in U.S. Pat. No. 6,427,778 and 6,109,351.

Despite these efforts a tubing pressure insensitive control system for deep set safety valves that had greater simplicity, enhanced reliability and lower production cost remained a goal to be accomplished. The present invention offers a system that features a single control line that acts on a piston that extends through spaced blocks so that it is substantially in pressure balance from tubing pressure. Each block has a tubing pressure seal while the piston carries a control line pressure seal in the upper block. A passage between the seals in the upper block extends preferably through the piston to a reservoir holding a compressible gas preferably near atmospheric pressure. The movement of the piston compresses the fluid in the reservoir and compresses a closure spring acting on the flow tube. Optionally, a spring or/and an equivalent can act on the piston directly to move the flow tube to close the valve. A redundant system can be provided so that when the primary system fails and is pressure equalized because of such failure, access into a redundant system from the same or separate control line can be obtained for continued operation of the valve.

Those skilled in the art will better appreciate the details of the invention from the description of the preferred embodiment and the drawings that appear below while recognizing that the full scope of the invention is indicated by the claims.

SUMMARY OF THE INVENTION

A control system can be used with a single control line to a subsurface safety valve. The operating piston is exposed to the flow tube between two blocks with near identical seals to make the piston insensitive to tubing pressure. A control system seal is carried by the piston in the upper block and a passage between the control system seal and the tubing pressure seal in the upper block communicates to a compressible fluid reservoir in the lower block that is also isolated from tubing pressure by a tubing pressure seal. Movement of the piston compresses the fluid in the reservoir. The reservoir can also include a spring to return the piston and the flow tube to a position to close the valve. A redundant system can be actuated if the primary system fails.

BRIEF DESCRIPTION OF THE DRAWINGS

FIG. 1 is a schematic system diagram of the proposed control system.

DETAILED DESCRIPTION OF THE PREFERRED EMBODIMENT

FIG. 1 shows a control system for downhole equipment and preferably a subsurface safety valve (SSSV). A single control line 10 extends to a first connection 12 in upper block 14 that is part of the SSSV housing (not shown). A piston 16 carries a seal 18 to define a variable volume 20 that is in part defined by interior surface 22 in upper block 14. Surface 22 defines a seal bore 24 in which a seal 26 is located. Seal 26 bridges the gap 28 from surface 22 to piston 16. Piston 16 has a shoulder 30 to abut flow tube 32 to push it down against a closure device, typically a spring and shown schematically in one location as arrow 34. Flow tube 32 is intended to generically refer to an operating mechanism in a downhole tool and to a flow tube in a specific embodiment of a SSSV. Those skilled in the art will know that when flow tube 32 is pushed down, a flapper (not shown) is pushed open on the SSSV. If the closure spring 34 is bearing directly on the flow tube 32, then a single shoulder 30 on the piston 16 is sufficient to shift the flow tube 32 down under pressure applied from control line 10 and to shift the flow tube 32 back up on removal of pressure at control line 10 so that the closure spring or equivalent, pushes directly up on flow tube 32 to allow the flapper to close.

Piston 16 extends into a lower block 36 that defines a chamber 38 having a wall 40 in which a seal 42 is located in seal bore 44 to span the gap 46. A passage 48 from gap 28 between seals 18 and 26 extends to chamber 38. Preferably, this passage goes through piston 16 but it can go through the valve body tubing, or some other alternate path to connect gap 28 and chamber 38.

The size of seals 26 and 42 is preferably nearly identical so that pressure effects from tubing pressure in area 50 have little to no effect on moving the piston 16 in either direction. In this context, the term "nearly identical" can be defined as the fact that a difference in tubing seal diameters is not enough to produce a detrimental increase in opening or closing pressure of more than 25%. Because of passage 48 seals 26 and 42 see a fairly high differential of tubing pressure 50 minus the pressure in chamber 38 which is preferably far lower. The pressure differential helps the sealing function in gaps 28 and 46.

Since seal 18 moves with piston 16 closer to seal 26 when shifting the flow tube 32 down to open the valve, the presence of passage 48 leading to chamber 38 allows this movement to happen because passage 48 and chamber 38 preferably contain, at least in part, a compressible fluid and preferably at fairly low pressures compared to tubing pressure 50 which can easily exceed 20,000 PSI. Apart from seal resistance to movement of piston 16 the force needed in the control line 10 to move piston 16 is principally to overcome the closure device 34 that directly acts on the flow tube, as one option. Alternatively, the closure can be accomplished with a spring or equivalent 52 located inside chamber 38 and acting directly on piston 16 instead of spring or equivalent 34 acting on the flow tube 32. In yet another option both locations can have springs or equivalent devices so that closure forces act on flow tube 32 and piston 16. A wave spring is preferred for spring 52 but equivalent energy storing devices can also be used. The preferred pressure in chamber 38 is atmospheric or a pressure close to it, but such a pressure can be higher and high enough to act as a partial or total closing force on the piston 16. This is a trade off as it is also desirable to have larger pressure differentials across seals 26 and 42 as possible to enhance sealing performance across gaps 28 and 46. To the extent any closure force for flow tube 32 comes from chamber 38 another shoulder 54 can be used for pushing the flow tube 32 up to allow the valve to close.

Normal operation is nothing more than applying pressure to control line 10 to move the piston 16 against a closure force, be it 34 or 52 or both or pressure from within chamber 38. Movement of piston 16 simply reduces the volume of chamber 38 and compresses the fluid inside it. To close the valve normally, the pressure is simply reduced in control line 10 and the closure device(s) take over and reverse the movement of the piston 16 and the flow tube 32.

Failure of seal 26 or 42 puts tubing pressure in chamber 38 to oppose control line pressure in control line 10. The control line pressure in applications with very high tubing pressure 50 will generally be no match in chamber 20 and the piston will move up under the greater force from chamber 38 or from simply the closure force from spring 34 or 52. Once equalized about piston 16 due to a seal failure of seal 26 or 42 further application of control line pressure will not reopen the valve. If seal 18 fails, the control line 10 pressure equalizes between chambers 20 and 38 and the valve closes by virtue of spring 34 or 52 and cannot be reopened.

In the event of a seal failure of the types described above, it is advantageous to have a redundant system shown schematically as 56 that is preferably identical to the system illustrated and works the same way. System 56 can be connected to control line 10 or through an independent control line through a rupture disc 58 that is set higher than the normal pressures expected for operation of the previously described control system. A filter 60 can be optionally used to contain any rupture disc parts after it is broken by elevating the pressure in the control line 10. Accordingly, if the main control system fails in the manners described above, the rupture disc 58 can be broken and system 56 will take over after the initial system is disabled. No amount of pressure to the initial operating system will actually move piston 16 due to the equalization that had already occurred to reach the point of having to break rupture disc 58 to be able to keep operating the valve. Alternatively, rupture disc 58 and filter 60 can be eliminated and the redundant systems can operate at all times in tandem from a single control line 10 that branches to service the redundant unit(s). Alternatively, another option can be to run a second, separate control line from the surface to rupture disc 58, to filter 60 and redundant operating system 56. If one system fails, as described above and becomes inoperative, the other system(s) can be activated and can continue operating in the normal manner.

Those skilled in the art will appreciate that the system is simple and features a piston insensitive to tubing pressures 50. While being insensitive to tubing pressures, it features a compressible fluid reservoir in a simple design with just 3 seals. It further provides an option to have a closure device acting right on the piston 16 rather than the flow tube 32 making the design more compact and possibly allowing a larger bore in the valve despite pressure ratings that can go above 20,000 PSI. The compactness of the design leaves room for a redundant system that can be selectively deployed if the initial system has a seal failure.

The above description is illustrative of the preferred embodiment and various alternatives and is not intended to embody the broadest scope of the invention, which is determined from the claims appended below, and properly given their full scope literally and equivalently.

We claim:

1. A control system for an operating mechanism in a downhole tool from a single control line extending from the surface, comprising:

a tool housing having a passage and at least one control line connection for fluid communication to the single control line;

at least one piston having a first portion in fluid communication with said control line connection, a second portion in pressure balance from exposure to said passage and a third portion defining, at least in part, a variable volume chamber isolated from said passage and from a hydrostatic force to offset the hydrostatic pressure in the control line and operating at about atmospheric pressure.

2. The system of claim 1, wherein:

said second portion of said piston comprises an upper and a lower seal between said piston and said tool housing that are nearly identical.

3. The system of claim 2, wherein:

said upper and lower seals have one side exposed to said passage and another side exposed to said variable volume chamber.

4. The system of claim 3, wherein:

said exposure of one of said seals to said variable volume chamber is through said piston.

5. The system of claim 3, wherein:

said exposure of one of said seals to said variable volume chamber is through said tool housing.

6. The system of claim 3, wherein:

said piston further comprises a piston seal, said exposure to said variable volume chamber is through a passage that starts between said piston seal and one of said upper and lower seals.

7. The system of claim 6, wherein:

said piston seal is mounted to said piston and closer to said upper seal.

8. The system of claim 3, wherein:

said exposure of one of said seals to said variable volume chamber is through a passage outside said piston.

9. The system of claim 1, wherein:

said variable volume chamber further comprises, at least in part, a compressible fluid.

10. The system of claim 9, wherein:

said compressible fluid is under pressure sufficient to move said piston toward said control line connection when pressure in said connection is reduced to a predetermined value.

11. The system of claim 1, wherein:

said piston comprises at least one shoulder to abut a flow tube for moving said flow tube in at least one direction against a bias force.

12. The system of claim 11, wherein:

said bias force is on said flow tube.

13. The system of claim 11, wherein:

said bias force is on said piston.

14. The system of claim 11, wherein:

said bias force is on said flow tube and said piston.

15. The system of claim 1, wherein:

said at least one control line connection comprises only one control line connection and said at least one piston comprised only one piston.

16. A control system for an operating mechanism in a downhole tool from a single control line extending from the surface, comprising:

a tool housing having a passage and at least one control line connection for fluid communication to the single control line;

at least one piston having a first portion in fluid communication with said control line connection, a second portion in pressure balance from exposure to said passage and a third portion defining, at least in part, a variable volume chamber isolated from said passage and from a hydrostatic force to offset the hydrostatic pressure in the control line; said variable volume chamber further comprises a biasing member acting on said piston.

17. The system of claim 16, wherein:

said biasing member comprises at least one spring.

18. A control system for an operating mechanism in a downhole tool from a single control line extending from the surface, comprising:

a tool housing having a passage and at least one control line connection for fluid communication to the single control line;

at least one piston having a first portion in fluid communication with said control line connection, a second portion in pressure balance from exposure to said passage and a third portion defining, at least in part, a variable volume chamber isolated from said passage and from a hydrostatic force to offset the hydrostatic pressure in the control line;

said at least one piston comprises at least two pistons with at least one selectively in communication with said control line connection.

19. The system of claim 18, wherein:

said selective communication comprises a breakable member responsive to applied pressure.

20. The system of claim 19, further comprising:

a filter to capture any pieces of said breakable member.

21. A control system for an operating mechanism in a downhole tool from a single control line extending from the surface, comprising:

a tool housing having a passage and at least one control line connection for fluid communication to the single control line;

at least one piston having a first portion in fluid communication with said control line connection, a second portion in pressure balance from exposure to said passage and a third portion defining, at least in part, a variable volume chamber isolated from said passage and from a hydrostatic force to offset the hydrostatic pressure in the control line;

said at least one piston comprises at least two pistons always in communication with said control line connection for operation in tandem.

22. A control system for an operating mechanism in a downhole tool from a single control line extending from the surface, comprising:

a tool housing having a passage and at least one control line connection for fluid communication to the single control line;

at least one piston having a first portion in fluid communication with said control line connection, a second portion in pressure balance from exposure to said passage and a third portion defining, at least in part, a variable volume chamber isolated from said passage and from a hydrostatic force to offset the hydrostatic pressure in the control line;

said at least one piston comprises at least two pistons, said at least one control line connection comprises at least two control line connections, with each piston in communication with a respective control line connection.

* * * * *